US009906880B2

(12) United States Patent
Van Doorn et al.

(10) Patent No.: US 9,906,880 B2
(45) Date of Patent: Feb. 27, 2018

(54) LISTENING SUPPORT DEVICE, IN PARTICULAR A HEARING AID, AND A COMPRESSIBLE CASE FOR APPLICATION THEREWITH

(75) Inventors: Jan Marinus Van Doorn, Alkmaar (NL); Randall Carey Dillon, Heerhugowaard (NL); Mark Alan Bren, St. Louis Park, MN (US); Timothy Scott Peterson, Lino Lakes, MN (US)

(73) Assignee: EXSILENT RESEARCH B.V., Amsterdam (NL)

( * ) Notice: Subject to any disclaimer, the term of this patent is extended or adjusted under 35 U.S.C. 154(b) by 0 days.

(21) Appl. No.: 14/233,237

(22) PCT Filed: Jul. 17, 2012

(86) PCT No.: PCT/NL2012/050513

§ 371 (c)(1),
(2), (4) Date: Mar. 26, 2014

(87) PCT Pub. No.: WO2013/012327

PCT Pub. Date: Jan. 24, 2013

(65) Prior Publication Data

US 2014/0219487 A1 Aug. 7, 2014

(30) Foreign Application Priority Data

Jul. 18, 2011 (NL) ..... 2007136

(51) Int. Cl.
*H04R 25/00* (2006.01)

(52) U.S. Cl.
CPC ..... *H04R 25/65* (2013.01); *H04R 25/00* (2013.01); *H04R 25/456* (2013.01); *H04R 25/60* (2013.01);

(Continued)

(58) Field of Classification Search
CPC .... H04R 25/60; H04R 265/65; H04R 25/652; H04R 25/656; H04R 25/6584;

(Continued)

(56) References Cited

U.S. PATENT DOCUMENTS 4,447,677 A 5/1984 Miyahra et al.
4,727,582 A 2/1988 de Vries et al.

(Continued)

FOREIGN PATENT DOCUMENTS

EP 2320681 A1 5/2011
WO 2006094502 A1 9/2006
WO 2008010716 A2 1/2008

OTHER PUBLICATIONS

International Search Report, dated Jan. 30, 2013, from corresponding PCT application.

(Continued)

*Primary Examiner* — Sean H Nguyen
(74) *Attorney, Agent, or Firm* — Young & Thompson

(57) ABSTRACT

A listening support device, such as in particular a hearing aid, includes a part (6) worn in the ear, wherein the part worn in the ear includes an electro-acoustic converter (61) and optionally also includes a microphone (62). The part worn in the ear includes a device housing (6) which is inserted releasably in a compressible case (30) which at least partially encircles the device housing laterally. The compressible case (30) is provided with at least one continuous channel (31,32,33) which provides for an open communication between a proximal side directed toward an outlet of the auditory canal and an opposite, distal side thereof.

10 Claims, 2 Drawing Sheets

(52) U.S. Cl.
CPC ..... *H04R 25/652* (2013.01); *H04R 25/654* (2013.01); *H04R 25/656* (2013.01); *H04R 25/658* (2013.01); *H04R 2225/021* (2013.01); *H04R 2225/49* (2013.01); *H04R 2460/09* (2013.01)

(58) Field of Classification Search
CPC ..... H04R 25/65; H04R 25/658; H04R 25/00; H04R 25/456; H04R 2225/021; H04R 2225/49; H04R 2460/09
USPC ..... 381/322
See application file for complete search history.

(56) References Cited

U.S. PATENT DOCUMENTS 5,712,918 A * 1/1998 Yoest ..... H04R 25/654 181/130
6,129,174 A 10/2000 Brown et al.
6,134,333 A * 10/2000 Flagler ..... H04R 25/654 181/130
6,795,562 B1 * 9/2004 Gunnersen ..... H04R 25/654 381/322
2003/0048920 A1 3/2003 Van Halteren et al.
2006/0153418 A1 7/2006 Van Halteren
2007/0264850 A1 * 11/2007 Bruckhoff ..... 439/83
2008/0123889 A1 5/2008 Caldarola
2008/0298618 A1 12/2008 Baumann et al.
2009/0074220 A1 3/2009 Shennib
2009/0092271 A1 * 4/2009 Fay et al. ..... 381/328
2009/0262964 A1 * 10/2009 Havenith et al. ..... 381/314
2010/0086158 A1 4/2010 Oberlander
2010/0098277 A1 4/2010 Giese et al.
2010/0166241 A1 7/2010 Sabio
2010/0272299 A1 * 10/2010 Van Schuylenbergh et al. ..... 381/315
2012/0070022 A1 * 3/2012 Saiki ..... H04R 9/063 381/312
2012/0076318 A1 * 3/2012 Aase et al. ..... 381/74

OTHER PUBLICATIONS

Dutch Search Report dated Mar. 6, 2012, from corresponding NL application.
European Office Action, dated Apr. 10, 2015, in corresponding European Patent Application No. 12 753 596.1.

* cited by examiner

LISTENING SUPPORT DEVICE, IN PARTICULAR A HEARING AID, AND A COMPRESSIBLE CASE FOR APPLICATION THEREWITH

BACKGROUND OF THE INVENTION

Field of the Invention

The present invention relates to a listening support device comprising a part worn in the ear which is intended and adapted to be received positioned at least substantially wholly in an auditory canal of a user, wherein the part worn in the ear comprises a device housing with an electro-acoustic converter which is releasably received in a compressible case, and wherein the case comprises between a sound emitting side of the converter and a sound emitting opening in a wall of the case an at least substantially open sound emitting channel provided with cerumen barrier means.

Description of the Related Art

Such a device is also referred to as an ALD (assistive listening device) and can take many forms, varying from a hearing aid for the deaf and hard(er) of hearing to earphones for audio reproduction which may or may not be natural, also referred to as a personal sound amplifier, and active sound filters. Characteristic for these devices is a microphone for receiving and converting ambient sound to an electronic signal corresponding therewith, and a signal processing device which amplifies this signal and/or supplies it in otherwise processed manner to an electro-acoustic converter (often referred to as transducer, receiver, speaker or loudspeaker) for the purpose of presenting the received sound in modified form to the hearing of the user. The ambient sound can thus be amplified for the purpose of an improved audibility, or harmful or irritating components can be filtered therefrom or the ambient sound can be attenuated in order to protect the hearing from hearing impairment.

A device of the type described in the preamble is for instance known from International patent application WO 2008/010716. The device described herein comprises a part worn in the ear which is received in a first device housing and received deeply and thereby wholly concealed in an auditory canal of the user. This device housing comprises at least the electro-acoustic converter and the microphone. In addition, the known device comprises a second device housing worn wholly outside the auditory canal of the user, behind or on the ear. Present herein is an electronic power source such as a capacitor or an optionally rechargeable battery. Also situated in the second device housing is the signal processing device which draws its electric power supply directly from the power source. For the purpose of a mutual electronic connection of the two parts of the device a multi-core cable connection is arranged therebetween which provides an electric power supply to the in-the-ear part and a signal transfer between the two parts. The placing of the microphone with the loudspeaker in the in-de-ear part of the device contributes significantly toward a natural perception of sound in that use is advantageously made here of an acoustic interaction between the captured sound and the natural anatomy of the auditory canal of the user. In this known device the part worn in the ear is inserted in one of the embodiments thereof into a soft, compressible case which fully seals the auditory canal locally.

Although such a device housing worn deep in the auditory canal has significant advantages from both a cosmetic and an acoustic viewpoint, it has the drawback that the sound emitting channel is relatively susceptible to blockage resulting from an accumulation of cerumen, also referred to as earwax.

The present invention has for its object, among others, to provide a listening support device with a part worn deep in the auditory canal, also referred to as a completely-in-canal (CIC) part, which is less susceptible to this phenomenon.

SUMMARY OF THE INVENTION

A listening support device of the type described in the preamble has for this purpose the feature according to the invention that the cerumen barrier means comprise at least one barrier body which extends transversely in the sound emitting channel and herein leaves at least a free space laterally within a cross-section of the sound emitting channel. A particular preferred embodiment of the device according to the invention has the feature here that the at least one barrier body comprises an at least substantially solid body which is formed integrally with the case at least close to the sound emitting opening, and is particularly rod-like or disc-like. Such a barrier body placed transversely inside the emitting channel is found in practice to be a simple yet no less effective means against entry of cerumen into the emitting channel. The channel thereby remains open for longer, thereby ensuring an adequate operation of the device for a longer period of time.

It has been found in practice that the local sealing of the auditory canal as a result of the part of the device worn in the ear is perceived by some users as irritating, this detracting from the wearer comfort but also from the clarity, quality and/or recognizability of the transmitted sound. A particular embodiment of the listening support device which is less susceptible thereto, while retaining acoustic advantages, has the feature according to the invention that the case at least almost wholly encircles the device housing laterally, and that the case is provided with at least one continuous channel which provides for an open communication between a proximal side directed toward an outlet of the auditory canal and an opposite, distal side thereof. The case thus allows a free airflow between a side of the device directed toward the eardrum of the user and a side thereof directed toward the auditory outlet, so that there is always a pressure equalization between the two sides.

The compressible case can for instance be composed of a rubber-like, bio-compatible plastic, for instance a hypoallergenic silicone rubber or polyurethane, and owing to the inherent flexibility thereof provides a certain damping of acoustic vibrations passing therethrough, such as for instance the own speech of the user and vibrations generated by the converter, so that they do not reach the microphone, or at least only do so in attenuated form. This improves the sound quality and reduces the chance of feedback in the device.

In order to prevent undesired feedback between the microphone and the converter, a further particular embodiment of the listening support device according to the invention has the feature that transversely of the auditory canal the at least one channel comprises an overall cross-section amounting to between 5 and 50% of a local cross-section of the auditory canal. At such a dimensioning possible remaining feedback can be captured and suppressed with a suitable programming of the signal processing device, which then also serves as feedback manager.

A particular preferred embodiment of the listening support device according to the invention has the feature here that the at least one channel comprises a number of, particularly three, longitudinal cavities in the case, which are placed at regular distances from each other in a peripheral direction, and more particularly that the case, at least in non-tensioned state, has a round cross-section with a diameter of between 6 and 10 millimeters, and that the cavities comprise at least substantially cylindrical passages, each having a diameter of about 15% of the diameter of the case. Such an embodiment provides in practice a correct balance between feedback suppression on the one hand and occlusion suppression on the other.

The present invention also relates to a listening support device comprising a part worn in the ear intended and adapted to be received positioned at least substantially wholly in an auditory canal of a user, and a part worn outside the ear intended and adapted to be worn at least substantially wholly outside an auditory canal of the user, wherein the part worn in the ear comprises at least a microphone and at least one electro-acoustic converter and wherein the part worn outside the ear comprises an electronic power source and a signal processing device, wherein the part worn in the ear and the part worn outside the ear are at least partially connected to each other by a wired connection, which connection comprises a multi-core connecting cable.

In order to suppress electronic interference in such a device such a listening support device according to the invention has the feature that the connecting cable comprises at least one connecting core connected to the microphone and that the at least one connecting core connected to the microphone is physically paired with a shielding core. In a preferred embodiment the listening support device according to the invention is moreover characterized in that the shielding core is coupled at least during operation to a fixed reference potential. The shielding core thus provides for an electromagnetic shielding of the connection of the microphone paired therewith, particularly if a fixed reference potential is applied here to the shielding core.

A particular embodiment of the device has the feature here according to the invention that the connecting cable comprises at least a first connecting core connected to the microphone and a second connecting core connected to the microphone, that the first connecting core connects an output of the microphone to an input of the signal processing device, and that the second connecting core couples a power supply connection of the microphone to a power supply connection of the power source.

Thus protecting the relatively weak microphone signal at the source from interference is found to make an effective contribution toward a more robust whole which will be less susceptible to electromagnetic interference, both from the outside and crosstalk between the connecting cores.

In a first particular embodiment the listening support device according to the invention is characterized in that the at least one connecting core connected to the microphone is individually wound with the shielding core to form a core pair. Thus winding the connecting core with a shielding core subject to a fixed potential already achieves an adequate improvement in the signal-to-noise ratio on the connecting core of the microphone, while the core pairs nevertheless remain sufficiently flexible to adjust without problem to the natural anatomy of the auditory canal during use.

An optimal shielding of the microphone connecting core is achieved with a preferred embodiment of the listening support device which is characterized according to the invention in that the shielding core co-axially encircles the connecting core connected to the microphone. The microphone core is thus wholly encased in a metal casing which is formed by the shielding core and preferably subject to a fixed or dynamic (reference) potential. This casing functions as a so-called Faraday cage, which can effectively prevent electromagnetic interference from the outside. This results in a significant improvement in the signal-to-noise ratio on the microphone core, and so a significant improvement in quality of the output signal generated by the device. A thickness of the coaxial casing is advantageously kept relatively thin so as not to unnecessarily impede the flexibility of the connecting cable.

With a view to retaining said flexibility a further particular embodiment of the listening support device according to the invention has the feature that the multi-core connecting cable comprises a first further connecting core and a second further connecting core between an output of the signal processing device and the electro-acoustic converter, which are both physically unpaired. This embodiment is based here on the insight that these further connecting cores receive their signal from the signal processing device, whereby the signal can if desired then be presented in amplified and/or digital manner. This signal is thus more robust and less susceptible to disruption, while the shielding core(s) in the same connecting cable will moreover already provide for some shielding. A pairing with a further shielding core is therefore advantageously dispensed with in the case of the first further connecting core and second further connecting core in favour of a flexibility and bendability of the connecting cable. This ultimately enhances the wearer comfort.

In order to relieve the electronic contacts on either side of the connecting core, a further preferred embodiment of the listening support device according to the invention has the feature that the connecting cable comprises a strengthening wire which is connected at a first outer end to the device housing of the in-the-ear part and is coupled at an opposite outer end to a housing of the part worn outside the ear, and that a free length of the strengthening wire between the device housing and the housing is at most equal to a shortest free length of each of the connecting cores in the connecting cable. The strengthening wire can for instance be formed from a plastic with sufficient tensile strength, such as particularly polyester or polyamide fibres, or comprise a metal wire, in particular a braided metal wire so as retain sufficient flexibility. Adapting the free length of the strengthening wire to that of the other cores in the connecting cable thus imparts a pull relief to these latter.

A random fixed potential can be applied per se to the shielding cores, although in a further preferred embodiment the listening support device according to the invention is characterized in that said shielding cores are earthed. The potential of the shielding core can thus also be employed as reference potential for the different electronic components of the device, particularly the microphone and the signal processing device.

In order to suppress further interference with the relatively weak microphone signal a further particular embodiment of the listening support device according to the invention has the feature that the part worn in the ear comprises a device housing in which the microphone and the electro-acoustic converter are accommodated, as well as a compressible case in which the device housing is releasably inserted and which at least partially encircles the device housing laterally.

In a further aspect the present invention relates to a listening support device comprising a part worn in the ear, intended and adapted to be received positioned at least substantially wholly in an auditory canal of a user, wherein the part worn in the ear comprises at least a microphone and at least one electro-acoustic converter. Such a listening support device is characterized according to the invention in that the at least one electro-acoustic converter comprises an electro-acoustic membrane with a first vibration direction, that the microphone comprises an electro-acoustic membrane with a second vibration direction and that the first vibration direction is oriented at an angle relative to the second vibration direction, particularly at least substantially a right angle. This embodiment is based on the insight that a component of the vibrations generated by the converter directed in the second vibration direction will be at least mainly responsible for undesirable feedback between the two components. By thus placing microphone and electro-acoustic converters with their vibration directions at an angle, and particularly a right angle, this interference component can be effectively reduced.

In a further aspect the invention relates to a listening support device comprising a part worn in the ear, intended and adapted to be received positioned at least substantially wholly in an auditory canal of a user, wherein the part worn in the ear comprises at least a microphone and at least one electro-acoustic converter, which is characterized according to the invention in that the at least one electro-acoustic converter comprises a first electro-acoustic membrane and a second electro-acoustic membrane, and that the first electro-acoustic membrane and the second electro-acoustic membrane are placed opposite each other with a mutually opposing vibration direction. This achieves that internally the vibrations of the two membranes at least partially quench each other in the first vibration direction, whereby an internal interference is suppressed as a result.

Although the listening support device according to the invention can be applied in many fields, such as particularly as earphone(s) (headset) for an optionally portable audio playback device, including optionally portable computers and communication equipment with an audio-output, the invention relates particularly to a hearing aid comprising the above specified listening support device according to the invention.

The invention thus generally provides a solution to undesired interference in the output signal, irrespective of its origin, which can be of electronic, acoustic or mechanical nature.

The invention also relates to the above described compressible case and will now be further elucidated on the basis of an exemplary embodiment and an accompanying drawing, in which:

BRIEF DESCRIPTION OF THE DRAWING FIGURES

The figures are otherwise purely schematic and not drawn to scale. For the sake of clarity some dimensions in particular may be exaggerated to a greater or lesser extent. Corresponding parts are designated in the figures with the same reference numeral.

DETAILED DESCRIPTION OF THE INVENTION

Figure 1:
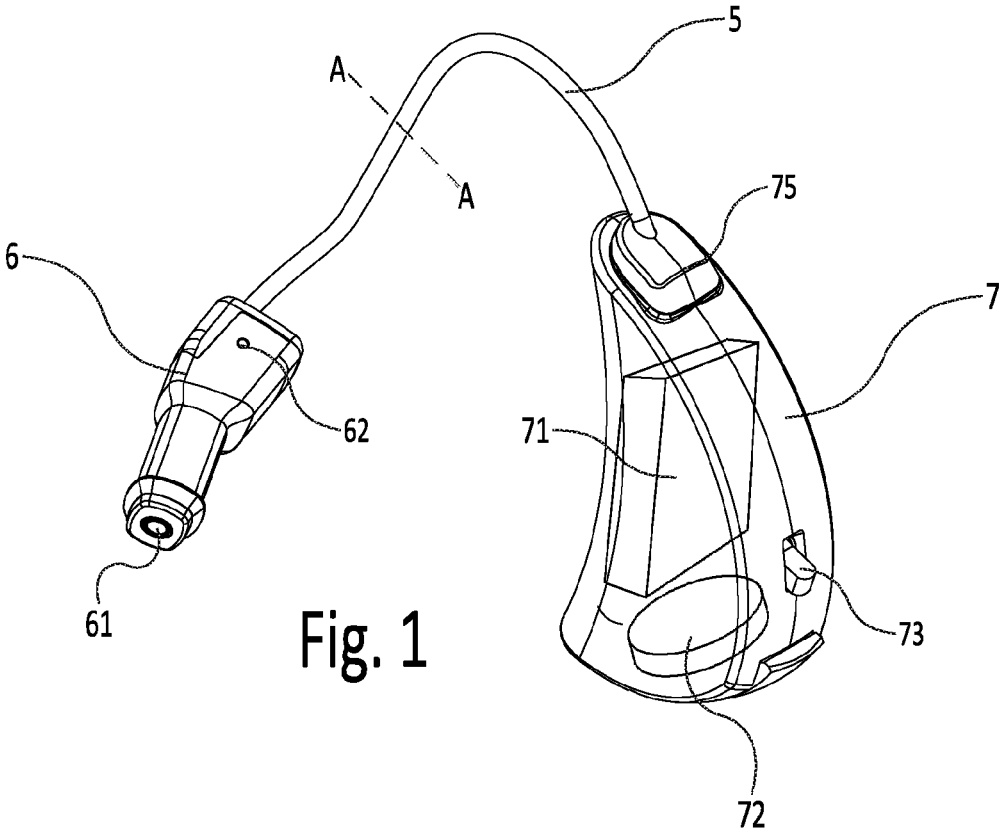
FIG. 1 shows a perspective view of an exemplary embodiment of a listening support device according to the invention.
Figure 3A:
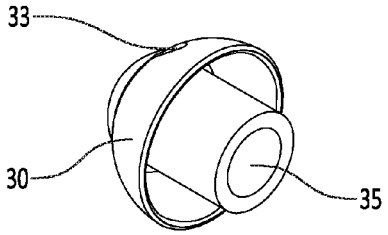
FIGS. 3A-F show cross-sections and perspective views of an exemplary embodiment of a compressible case according to the invention which can be applied with the listening support device of FIG. 1.
Figure 3B:
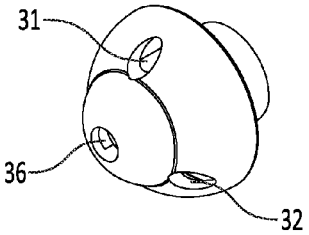
Figure 3C:
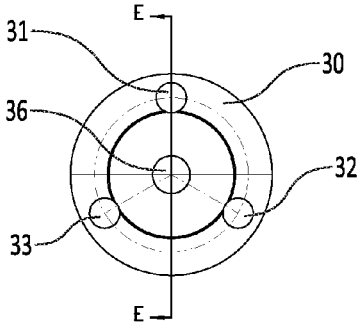
Figure 3D:
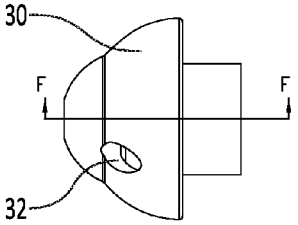
Figure 3E:
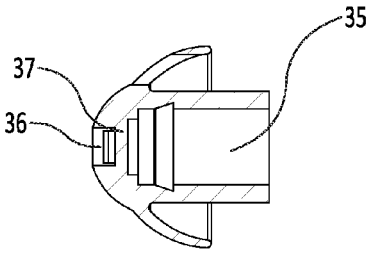
Figure 3F:
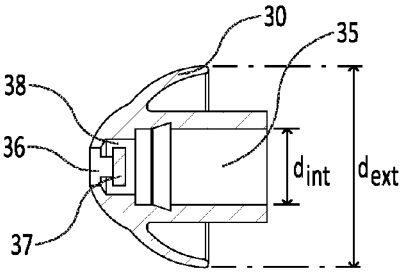

The device shown in FIG. 1 comprises a device housing 6 intended and adapted to be received wholly inside an auditory canal of a user. An outer casing of device housing 6 is for this purpose modelled to the natural anatomy of the auditory canal or, as in this case, is inserted into a compressible case of soft elastic material, normally referred to as a soft-tip. A material commonly used for this purpose is silicone rubber or other suitable, bio-compatible elastomer which shapes itself comfortably to the natural anatomy of the auditory canal. For the sake of clarity the compressible case is shown separately in FIGS. 3A-3F. FIGS. 3A-3B show the compressible case in different perspective views. FIGS. 3C-D show the compressible case in respectively front view and side view. FIGS. 3E-F show the compressible case in cross-section, respectively along lines E-E and F-F.

Case 30 comprises a number of cylindrical passages (cavities) 31, 32, 23 which thereby provide a number of open air channels through which a free airflow is ensured between a distal and a proximal side of the device in the ear. Case 30 comprises a cavity 35 with a uniform internal dimension $d_{int}$, into which the form-retaining device housing 6 with loudspeakers 61 is inserted, but is supplied with three external dimensions $d_{ext}$, i.e. a diameter of respectively 6, 8 and 10 millimeters, which will usually suffice for most users. The size of channels 31, 32, 33 is adapted hereto in the sense that the total air passage will amount to a maximum of about 15% of the overall cross-section of the case. This example has in this respect three such cylindrical cavities 31 . . . 33, each with a diameter of about 1.0, 1.2 or 1.4 millimeters at an external dimension $d_{ext}$ of respectively 6, 8 and 10 millimeters of the case itself.

On a distal side the device housing comprises an emitting opening 61 of an electro-acoustic converter lying therebehind for the purpose of emitting sound generated thereby almost directly to an eardrum of the user. Provided in line therewith in case 30 is a corresponding emitting opening 36. Situated between emitting opening 61 of the device housing and emitting opening 36 of case 30 is a sound emitting channel which provides free passage for sound generated by the converter.

Provided between the two emitting openings 61, 36 for the purpose of preventing entry of cerumen are cerumen barrier means in the form of a disc-like or rod-like barrier body 37 which extends close to the sound emitting opening 36 in a transverse direction in the emitting channel but which leaves space 38 clear along the sides in order to nevertheless allow the sound to pass through relatively undisturbed. In this embodiment barrier body 37 is formed integrally with case 30 from the same material as the case.

On a proximal side the device housing comprises a microphone behind an opening 62 in an outer casing, whereby ambient sound which has penetrated the auditory canal can be captured. The microphone is able to convert the captured sound to a representative electronic audio signal, and is for this reason also referred to as primary transducer or converter, opposite the electro-acoustic converter 61 or loudspeaker which functions as secondary transducer.

In order to prevent feedback between converter 61 and microphone 62, which could be perceived as irritating, the two components are placed at an angle relative to each other, in this embodiment even at a right angle, in respect of a natural vibration direction of the electro-acoustic membranes which are present in these components and which are ultimately responsible for the desired conversion. Vibrations are thus not transmitted, or only to a limited extent, from the one membrane to the other. In this embodiment a converter 61 in dual form is moreover applied, with two membranes in opposed orientation to each other so that internally directed, parasitic vibrations thereof will already at least partially quench each other. For a similar effect two single convertors can also be applied back-to-back.

The output signal of the microphone is generated to a signal processing device (DSP) 71 which amplifies and/or processes the signal before transmitting it to loudspeaker 61. In the present invention the signal processing device 71 is housed together with an electric power source in the form of an optionally rechargeable battery 72 in a second device housing 7 which is worn wholly outside the auditory canal, behind or on the ear. The second device housing moreover provides space for a control switch 73 with which the device can be activated or deactivated, and in some cases adjusted according to the wishes of the user. It is optionally also possible to dispense with a physical control switch, and use can in that case be made of for instance a fixed setting, which can optionally be adjusted or programmed outside the ear, or the device can be adjusted by means of specific sound pulse patterns.

Figure 2:
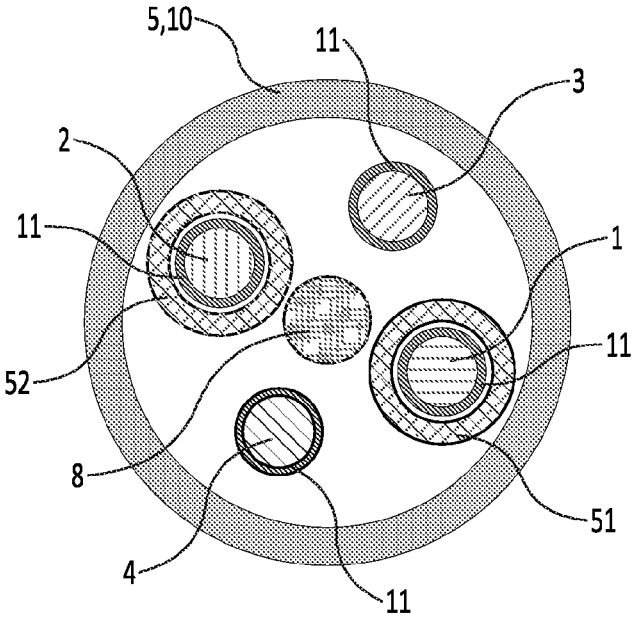
FIG. 2 shows a cross-section of the connecting cable along the line A-A in FIG. 1.

The two parts of the device are mutually connected by means of a multi-core connecting cable 5 which is further shown in cross-section in FIG. 2. The connecting cable has an insulating outer sheath 10 of a suitable plastic and has a diameter of several tenths of a millimeter to several millimeters, in this case about 1.0 millimeter. In respect of the outer sheath in this embodiment a polyether-polyamide block co-polymer has been selected as high-grade biocompatible plastic, which is commercially available under the name PEBAX. It is instead however also possible, if desired, to apply another, less complex plastic such as polyethylene, polypropylene.

Situated inside the sheath is a first connecting core 1 and a second connecting core 2. The first connecting core 1 is coupled to an output of microphone 62 and connects it electronically to a corresponding input of the signal processing device 71. The second connecting core 2 connects a pole of battery 72, usually the positive pole, to a corresponding power supply connection of microphone 62. The second connecting core can optionally also be connected instead to a voltage regulator, which ordinarily forms part of the signal processing device 71. Both connecting cores comprise a core of braided silver, gold or copper wire for the purpose of a low electronic impedance in combination with a high mechanical flexibility. Situated therearound is an insulating sheath 11 of plastic.

In order to shield the microphone signal from external electromagnetic interference, both the first and the second connecting cores in cable 5 are paired with a shielding core 51, 52 which during use is subject to a fixed supply potential. Such a further core 51, 52 can for this purpose be wound with respectively first core 1 and second core 2 or, as in this embodiment, be arranged co-axially therearound. This latter provides an optimal protection against disruptive outside influences which could otherwise have an adverse effect on the signal-to-noise ratio of the signal. In this embodiment both further cores 51, 52 are earthed and thereby also serve as carrier of a reference potential for microphone 62 and the signal processing device 71.

In addition to the first and second connecting cores 1, 2, the multi-core cable 5 also comprises for the purpose of connection of microphone 62 a first further connecting core and a second further connecting core 3, 4, with which loudspeakers 61 are coupled to the signal processing device 71. Other than the first set of cores 1, 2, this latter set 3, 4 is not paired with a shielding core so as to not reduce the flexibility of the cable unnecessarily, with a view to the eventual wearer comfort of the device. Taken into account here is an optional signal amplification from the signal processing device 71, which makes the signal-to-noise ratio of the output signal less susceptible to interference, while crosstalk from or to the first set of cores is already suppressed by the co-axial sheath 51, 52 present therearound.

Finally received in the cable is a strengthening wire 8 having a shorter free length between the two device housings 6, 7 than that of the shortest of the other cores 1, 2, 3, 4, 51, 52 in cable 5. This strengthening wire is connected on either side to a fixed housing part of the relevant device housing 6, 7 and thereby provides a pull relief for electronic cores 1, 2, 3, 4, 51, 52. In this embodiment use is made for strengthening wire 8 of braided or wound aramid fibres because of their excellent tensile strength. Other materials with tensile strength can also be applied instead, such as for instance a metal wire or another plastic.

Cable 5 can be connected to the relevant part of the device on one of the two or both outer ends by means of a soldered connection, or be coupled thereto via a detachable microplug construction. In this embodiment use is made of a fixed solder connection in respect of the part 6 worn in the ear, while such a micro-connector 75 is used on the part worn outside the ear.

Although the invention has been further elucidated with reference to this one embodiment, it will be apparent that the invention is by no means limited thereto. On the contrary, many other variations and embodiments are possible within the scope of the invention for the person with ordinary skill in the art. If desired, a detachable micro-connector can also be applied on the part worn in the ear, wherein use is then advantageously made of a multi-layer thin-film connector of alternate conductive metal layers and insulating polymer intermediate layers.

In addition to the part worn in the ear, the described exemplary embodiment also comprises a part worn outside or behind the ear in which further electronics are accommodated. In at least a number of its aspects the invention can however also be applied to a listening support device which is fully integrated into a part worn in the ear and further lacks a part physically connected thereto outside the ear.

In the shown example the microphone and the electro-acoustic converter are placed transversely of each other in respect of a vibration direction of acoustic membranes provided therein. Particularly when the converter comprises acoustic membranes operating in opposite directions, it can already also be advantageously applied in line with a vibration direction of the microphone.

The invention claimed is:

1. A listening support device comprising:

a part worn in the ear which is adapted to be received positioned at least substantially wholly in an auditory canal of a user, wherein the part worn in the ear comprises:

a device housing with an electro-acoustic converter; and a compressible case which releasably receives the device housing, the case comprising, between a sound emitting side of the converter and a sound emitting opening in a wall of the case, an at least substantially open sound transmission channel provided with a cerumen barrier, the cerumen barrier comprising at least one barrier body behind the sound emitting opening which extends transversely in the sound transmission channel and therein leaves at least a free space laterally along sides of the at least one barrier body within a cross-section of the sound transmission channel, wherein the at least one barrier body comprises an at least substantially solid body which is formed integrally with the case at least close to the sound emitting opening, and is rod shaped or disc shaped.

2. The listening support device as claimed in claim 1, wherein the case at least almost wholly encircles the device housing laterally, and that the case is provided with at least one continuous channel which provides for an open communication between a proximal side directed toward an outlet of the auditory canal and an opposite, distal side thereof.

3. The listening support device as claimed in claim 2, wherein transversely of the auditory canal the at least one continuous channel comprises an overall cross-section amounting to between 5 and 50% of a local cross-section of the auditory canal.

4. The listening support device as claimed in claim 2, wherein the at least one continuous channel comprises a number of, or three, longitudinal cavities in the case, which are placed at regular distances from each other in a peripheral direction.

5. The listening support device as claimed in claim 4, wherein the case, at least in non-tensioned state, has a round cross-section with a diameter of between 6 millimeters and 10 millimeters, and the cavities comprise at least substantially cylindrical passages, each having a diameter of about 15% of the diameter of the case.

6. A hearing aid comprising the listening support device as claimed in claim 1.

7. A case as in the listening support device as claimed in claim 1.

8. The listening support device as claimed claim 1, wherein the case at least almost wholly encircles the device housing laterally, and the case is provided with at least one continuous channel which provides for an open communication between a proximal side directed toward an outlet of the auditory canal and an opposite, distal side thereof.

9. A listening support device comprising:

a part worn in the ear, and adapted to be received positioned at least substantially wholly in an auditory canal of a user, the part worn in the ear comprising:

at least a microphone; and at least one electro-acoustic converter, the at least one electro-acoustic converter comprising an electro-acoustic membrane with a first vibration direction, the first vibration direction is aimed in a direction towards the auditory canal, wherein the microphone comprises an electro-acoustic membrane with a second vibration direction, wherein the first vibration direction is oriented at an angle relative to the second vibration direction, wherein the part worn in the ear further comprises:

a compressible case which releasably receives a device housing, the case comprising, between a sound emitting side of the electro-acoustic converter and a sound emitting opening in a wall of the case, an at least substantially open sound transmission channel provided with a cerumen barrier, the cerumen barrier comprising at least one barrier body behind the sound emitting opening which extends transversely in a sound transmission channel and therein leaves at least a free space laterally along sides of the at least one barrier body within a cross-section of the sound transmission channel, wherein the at least one barrier body comprises an at least substantially solid body which is formed integrally with the case at least close to the sound emitting opening, and is rod shaped or disc shaped.

10. A listening support device comprising:

a part worn in the ear, adapted to be received positioned at least substantially wholly in an auditory canal of a user, the part worn in the ear comprising:

at least a microphone; and at least one electro-acoustic converter, the at least one electro-acoustic converter comprising a first electro-acoustic membrane and a second electro-acoustic membrane, and the first electro-acoustic membrane and the second electro-acoustic membrane are placed opposite each other with a mutually opposing vibration direction, the vibration direction being aimed towards the auditory canal, wherein the part worn in the ear further comprises:

a compressible case which releasably receives a device housing, the case comprising, between a sound emitting side of the electro-acoustic converter and a sound emitting opening in a wall of the case, an at least substantially open sound transmission channel provided with a cerumen barrier, the cerumen barrier comprising at least one barrier body behind the sound emitting opening which extends transversely in a sound transmission channel and therein leaves at least a free space laterally along sides of the at least one barrier body within a cross-section of the sound transmission channel, wherein the at least one barrier body comprises an at least substantially solid body which is formed integrally with the case at least close to the sound emitting opening, and is rod shaped or disc shaped.

* * * * *